US007073497B2

(12) United States Patent
Dennis et al.

(10) Patent No.: US 7,073,497 B2
(45) Date of Patent: Jul. 11, 2006

(54) CANDLE ARRANGEMENT

(76) Inventors: John D. Dennis, 1086 Mountain Oak Pl., Newbery Park, CA (US) 91320; Bernard Urfig, 1374 Marine Drive, North Vancouver, British Columbia (CA) V7P 1T4

( * ) Notice: Subject to any disclaimer, the term of this patent is extended or adjusted under 35 U.S.C. 154(b) by 196 days.

(21) Appl. No.: 10/866,200

(22) Filed: Jun. 10, 2004

(65) Prior Publication Data

US 2005/0276040 A1 Dec. 15, 2005

(51) Int. Cl.
*F23D 3/16* (2006.01)

(52) U.S. Cl. ..... 126/295; 126/289

(58) Field of Classification Search ..... 126/295, 126/289, 293

See application file for complete search history.

(56) References Cited

U.S. PATENT DOCUMENTS

| | | | | |
|---|---|---|---|---|
| 2,324,723 | A | | 7/1943 | Power et al. |
| 3,388,960 | A | | 6/1968 | Canglialosi |
| 3,428,409 | A | * | 2/1969 | Summers ..... 431/289 |
| 3,706,523 | A | | 12/1972 | Kumm |
| 3,741,711 | A | | 6/1973 | Bryant |
| 3,826,606 | A | | 7/1974 | Hicks |
| 4,917,597 | A | * | 4/1990 | Henze ..... 431/289 |
| 6,036,477 | A | | 3/2000 | Frandsen |
| 6,050,812 | A | * | 4/2000 | Chuang ..... 431/253 |
| 6,276,925 | B1 | | 8/2001 | Vargas |
| 6,375,455 | B1 | | 4/2002 | Frandsen et al. |
| 6,409,501 | B1 | | 6/2002 | Pappas et al. |
| 6,440,362 | B1 | | 8/2002 | Bryant et al. |

* cited by examiner

*Primary Examiner*—Alfred Basichas
(74) *Attorney, Agent, or Firm*—Don Finkelstein

(57) ABSTRACT

A candle arrangement having a main candle body having a relatively high melting point and the main candle body has an aperture therethrough and a plurality of burning candles having a candle wax with a lower melting point than the main candle body are slidably mounted in the aperture. The burning candle at the top of the main candle body may be burned and then discarded after it is consumed and replaced with a new burning candle.

17 Claims, 4 Drawing Sheets

FIG. 4
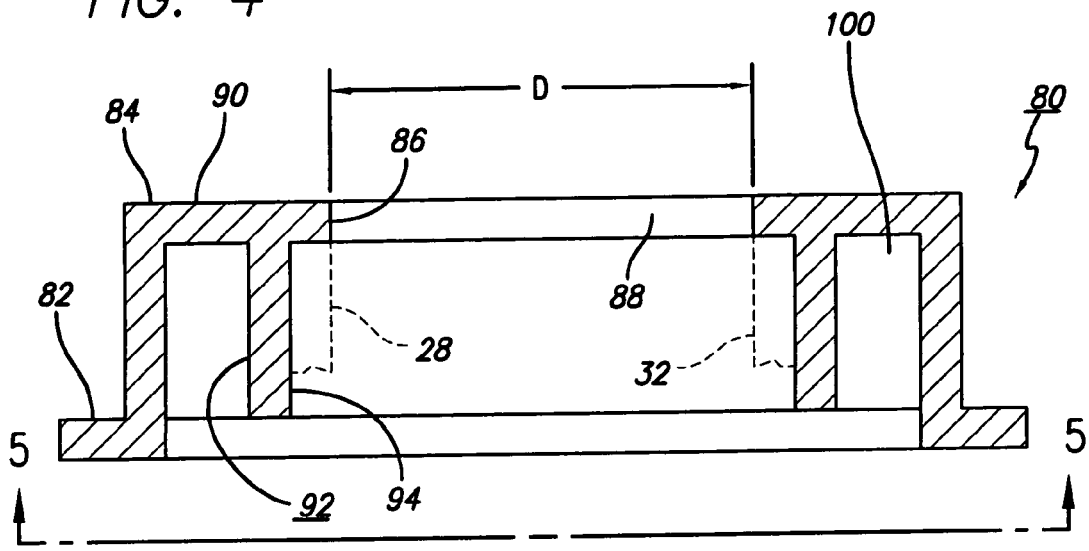
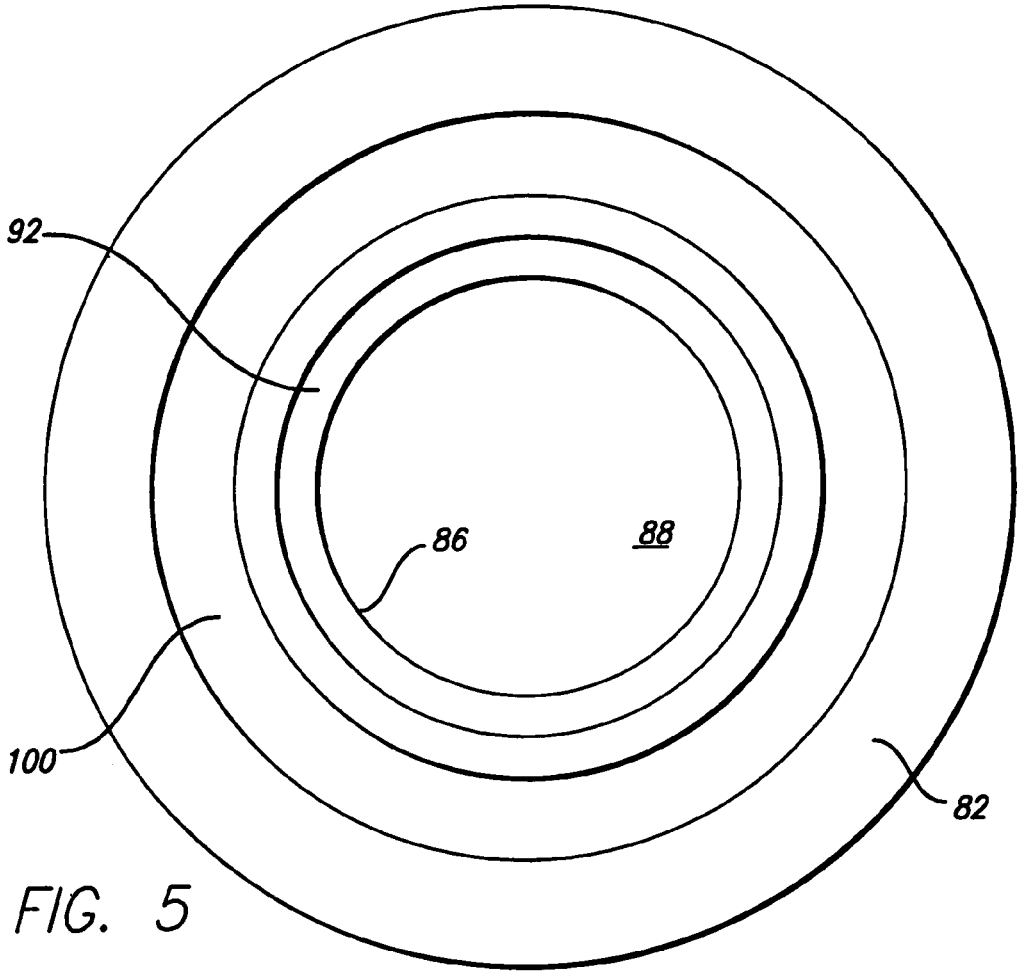
FIG. 5

FIG. 7
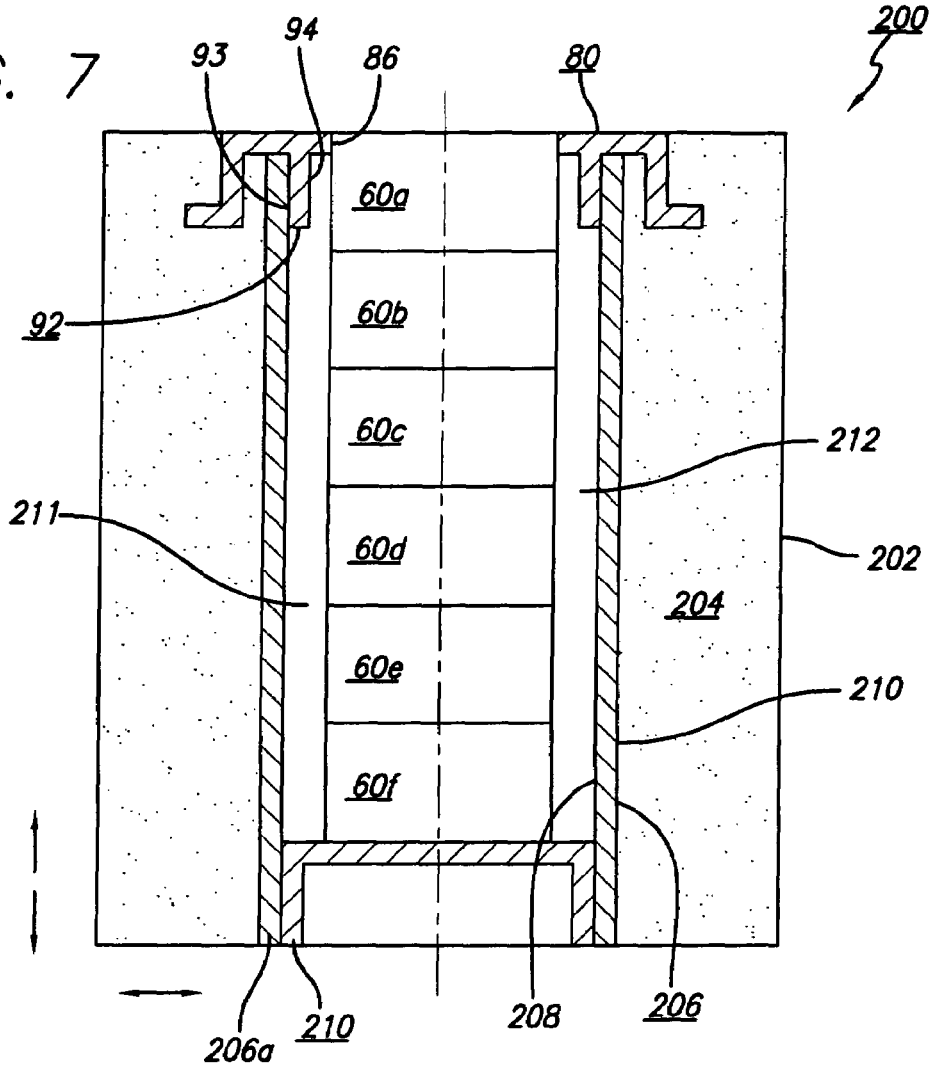
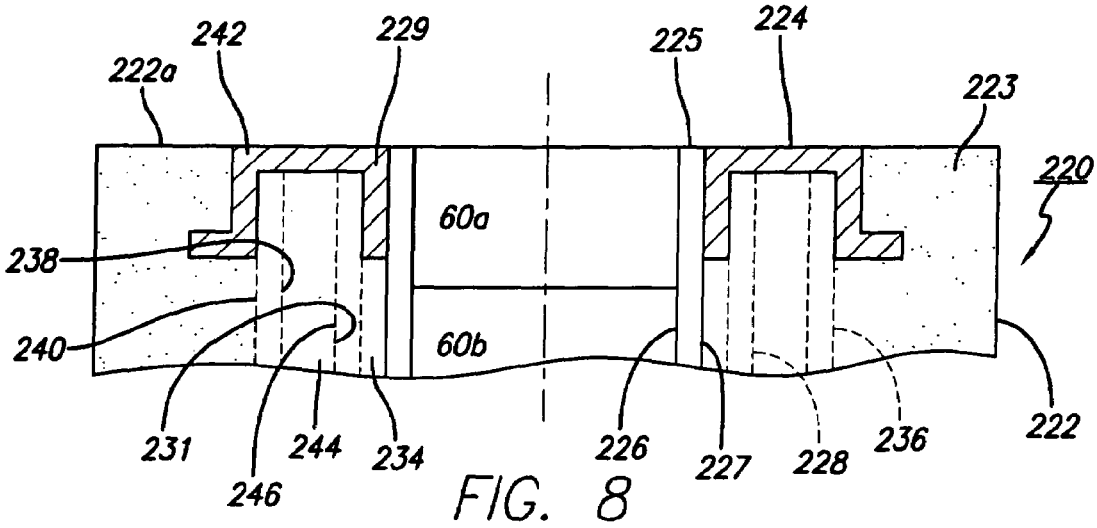
FIG. 8

CANDLE ARRANGEMENT

BACKGROUND OF THE INVENTION

1. Field of the Invention

This invention relates to the candle art and more particularly to an improved decorative multiple candle configuration and the method of making the multiple candle configuration.

2. Description of the Prior Art

Candles are often presently utilized both for light and for decorative purposes. Many varieties of decorative candles have been produced in the past. One technique for providing a decorative candle has been to place a candle in a shell or votive. The votive was often made of glass and this increased the weight of the assembled candle and votive. Such candle assembles were often only used once and the votive was discarded after the candle was burned. Since the votive or shell could be decorated in as fancy or attractive fashion as desired by the inclusion of colored materials such as pebbles, beans, candies or the like, the cost of such a shell or votive often exceeded the cost of the candle itself. It was often desired to have the external appearance of the candle to be visually of the appearance of a candle: that is, to look like a wax candle. To achieve this configuration, the candle wax itself included foreign materials such as herbs to provide a pleasing scent to the candle while burning, or colored beads or other decorative materials in the candle wax. Since the candle wax was consumed during the burning, such configurations were a single use candle.

In other prior art candle configurations, relatively large outer diameter shells were provided within which there was a cavity or recess. A smaller candle element could be placed into the cavity or recess and successively replaced as burned. In such arrangements, the material of the shell was either incombustible or of a higher melting temperature than the smaller candle. Only one smaller candle at a time was placeable in the shell. However, removing the burned candle to allow the replacement thereof by a new candle often was difficult and time consuming. Further, the provision of only one smaller candle placeable in the shell at any one time limited the usefulness of such candles.

Thus there has been a need for a candle arrangement in which the outer or decorative shell is not consumed and a plurality of smaller candles may be contained in the shell and replacement smaller candles may be quickly and easily inserted into proper candle burning position in the shell as each smaller candle is burned.

SUMMARY OF THE INVENTION

It is an object of the present invention to provide an improved candle arrangement.

It is another object of the present invention to proved an improved candle arrangement in which the outer shell thereof is not consumed during the burning of the candle.

It is yet another object of the present invention to provide a candle arrangement in which a decorative outer shell is configured to allow the insertion therein of a smaller candle.

It is a still further object of the present invention to provide a candle arrangement in which a decorative outer shell is reusable and not consumed during the burning of a candle and which shell contains a plurality of smaller candles moveable therein which smaller candles may be successively located in a preselected position in the shell for burning.

The above and other objects of the present invention are achieved, according to a preferred embodiment, by providing an outer main candle body having a predetermined melting point. The external periphery of the main candle body may be round, rectangular, square or any other desired geometric shape. The main candle body has an aperture extending therethrough from the upper surface to the lower surface of the main candle body. A rigid or semi-rigid preferably thin walled tubular member having any desired geometric configuration lines the aperture in the main candle body. A retainer member is attached to the outer surface of the tubular member at the top end of the main candle body and extends outwardly therefrom in the main candle body. The retainer member preferably has a flange extending outwardly towards the outer periphery of the main candle body and is embedded in the main candle body a preselected distance from the top end of the main candle body.

A plurality of burning candles are movably positioned in the tubular member for sliding motion therein. Each of the plurality of burning candles has a tubular case and a base member spaced from the bottom edge of the tubular case to define a separating ring of the tubular case between the base and the end of the tubular case. The inside of the tubular case is provided with a wick fixed to the inside of the base and extending upwardly therefrom and the inside of the tubular case is filled with a burning candle wax which may be of conventional composition but has a melting point lower than the melting point of the main candle body so that the burning of the burning candle does not melt the main candle body.

The separating ring on the bottom of each burning candle engages the top of the tubular case of the burning candle beneath it in the tubular member. Such engagement is intended to prevent the base of the burning candle from engaging the candle wax in the next burning candle. The top most burning candle in the tubular member is preferably positioned so that the wick thereof projects above the top surface of the main candle body.

In use, the wick of the top most burning candle is lit and the candle continues to burn until it is consumed. The consumed burning candle is removed from the main candle body by pressing downwardly thereon until the bottom most burning candle is ejected from the tubular member. The ejected burning candle and is then replaced at the top of the tubular member to be used when desired. Alternatively, the burned burning candle may be removed from the tubular member by pressing upwardly on the bottom most burning candle until the burnt burning candle at the top is ejected and the next burning candle is positioned at the top of the tubular member.

The above described process may be repeated as often as desired by the inclusion of new burning candles to replace the burned burning candles.

In order to fabricate the main candle body, in the preferred embodiment of the present invention, a mold is used. The mold has an outer case that is tubular in configuration and a base extending across the bottom of the outer case. The tubular member of the main candle body is positioned in the outer case and, for the embodiment wherein the main candle body and the tubular member are circular in cross section, the tubular member is positioned co-axially with the axis outer case to be positioned coaxially in the finished main candle body.

A plug having an outer diameter corresponding to the outer diameter of the burning candle and having a preselected axial length is secured to the base of the mold in a co-axial alignment with the axis of the outer case. The tubular member is placed over the plug and is retained in position thereby. The retainer member is positioned over the outer surface of the tubular member and abuts the inside surface of the base of the mold.

The annular volume between the inner wall of the outer case of the mold and the outer wall of the tubular member is filled with the relatively high melt point wax or other material to form the main candle body. After the wax of the main candle body has hardened, the mold is removed and the plurality of burning candles are inserted into the inside of the tubular member.

The outer case of the mold may be continuous in which case the main candle body is removed therefrom in an axial direction or the outer case may be a "clam shell" case hinged axially on one side to allow removal of the main candle body.

In some embodiments of the present invention, the retainer may be fabricated integrally with the tubular member.

The inside wall of the base of the mold may be decorated in any desired configuration to, for example, emboss a design on the top surface of the main candle body. Similarly, the inside wall of the "clam shell" type outer case of the mold may be decorated in any desired configuration to emboss a design on the outer wall surface of the main candle body.

In another embodiment of the present invention, the tubular member is spaced apart from the burning candles to leave an air gap therebetween to provide atonal thermal insulation.

BRIEF DESCRIPTION OF THE DRAWING

The above and other objects of the present invention my be more fully understood from the following detailed description taken together with the accompanying drawing wherein similar reference characters refer to similar elements throughout and in which:

FIGS. 4 and 5 illustrate a retainer useful in the practice of the present invention;

FIG. 7 illustrates another preferred embodiment of the present invention; and FIG. 8 illustrates another preferred embodiment of the present invention

DESCRIPTION OF THE PREFERRED EMBODIMENTS

Figure 1:
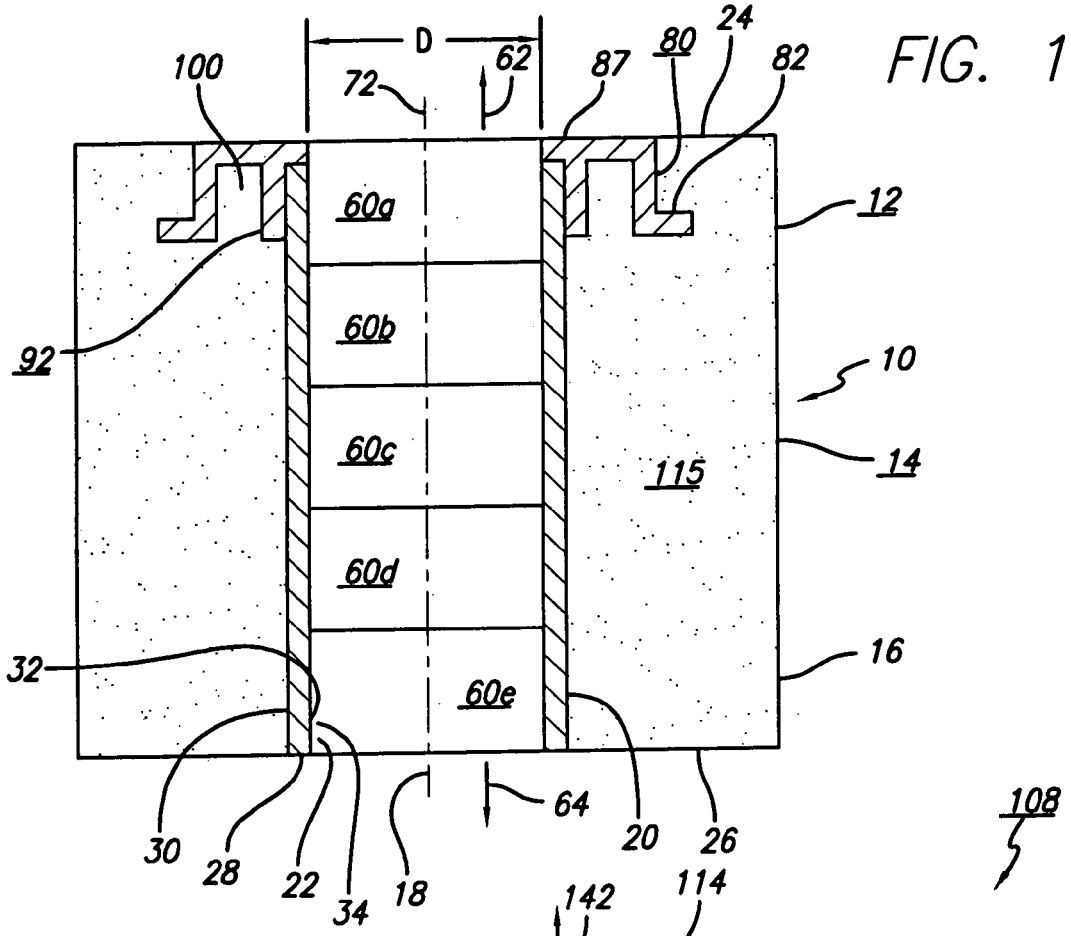
FIG. 1 is a cross sectional view of a preferred embodiment of the present invention.

Referring now to the drawing, there is illustrated in FIG. 1 a preferred embodiment, generally designated 10, of a candle arrangement 12 according to the principles of the present invention. The candle arrangement 12 is provided with a main candle body 14 which may be fabricated, in a preferred embodiment, of a candle wax 115 having a first, relatively high, melting point. Alternatively, in other embodiments, the main candle body may be fabricated from preferable incombustible material, a high melting point plastic, or the like. As shown on FIG. 1, the main candle body 14 has an external peripheral wall surface 16 that is circular in cross section about a central axis 18. In other embodiments of the present invention, the cross section geometry of the main candle body 14 may be square, rectangular or any other desired shape.

The main candle body 14 is provided with walls 20 defining an aperture 22 extending from the upper surface 24 of the main candle body to the lower surface 26 of the main candle body. A rigid or semi-rigid, preferably thin walled tubular member 28 is positioned in the aperture 22 of the main candle body 14 and the outer surface 30 of the tubular member 28 abuts the walls 20 of the aperture 22 in the main candle body 14. The inner walls 32 of the tubular member 28 define a candle receiving cavity 34 extending the axial length thereof. The tubular member 28 as shown on FIG. 1 is circular in cross section and concentric about the axis 18. In other embodiments of the present invention, the cross sectional configuration of the tube member 28 may be any desired geometry as long as the inner walls thereof define the desired candle receiving cavity. The candle receiving cavity may also be any desired cross sectional configuration In yet other embodiments of the present invention, a plurality of apertures extending from the upper surface to the lower surface of the main candle body and a each such aperture provided with a tubular member therein as above described for the purposes as below set forth. An end 10 view of the upper surface of such an embodiment, generally designated 40 is illustrated in FIG. 6.

Figure 6:
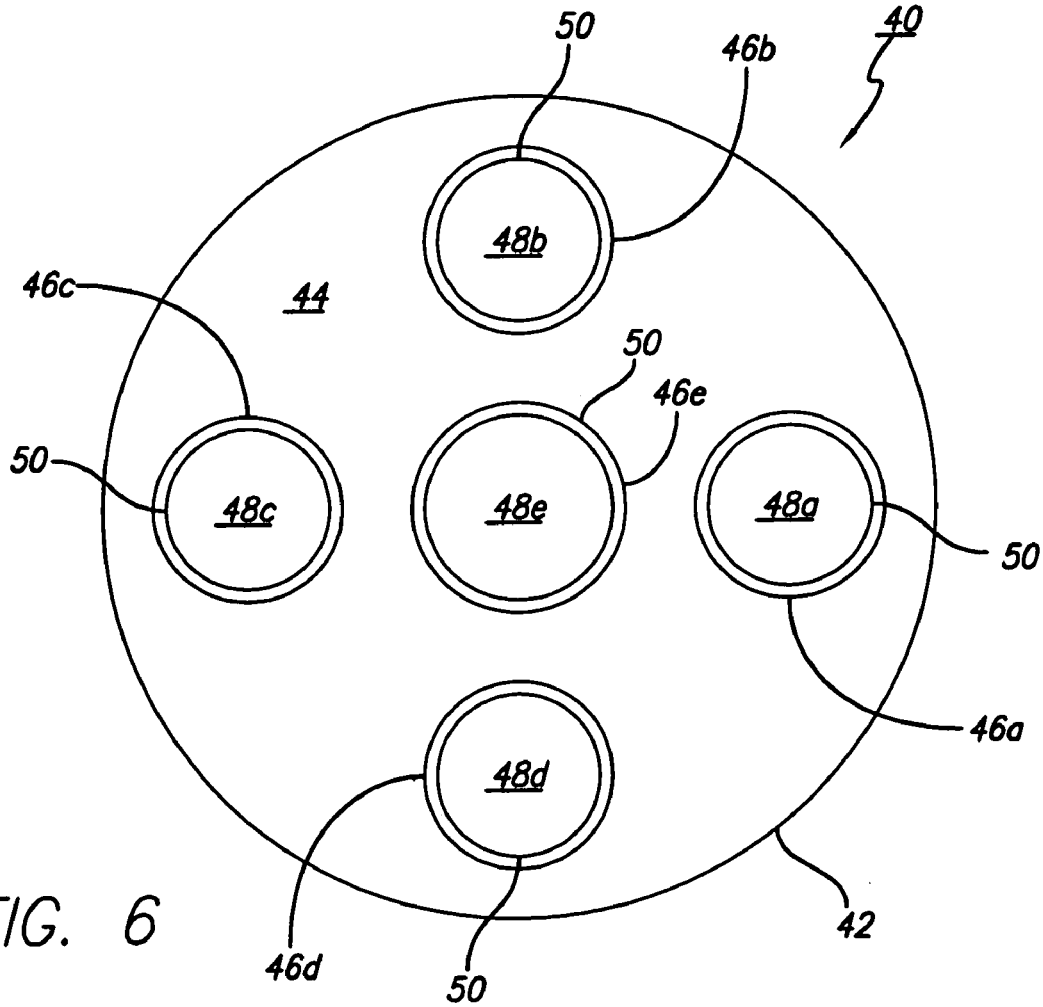
FIG. 6 illustrates another preferred embodiment of the present invention.

As shown in FIG. 6, a main candle body 42, which may be generally similar to the main candle body 14 described above, has an upper surface 44. The main candle body 42 is provided with walls 46*a*, 46*b*, 46*c*, 46*d*, and 46*e* defining a plurality of apertures 48*a*, 48*b*, 48*c*, 48*d* and 48*e* therein. Each of the apertures 48*a*, 48*b*, 48*c*, 48*d* and 48*e* is provided with a tubular member 50 therein and the tubular members 50 may be generally similar to the tubular member 28 described above. As shown on FIG. 6, there are five apertures provided in the main candle body 42.

However, the number of apertures may be any desired number for particular applications. Additionally, the apertures need not all be the same size. As shown on FIG. 6, aperture 48*e* is larger than apertures 48*a*, 48*b*, 48*c*, and 48*d*.

As shown on FIG. 1, a plurality of substantially identical burning candles 60*a*, 60*b*, 60*c*, 60*d* and 60*e* are slidingly mounted in the candle receiving aperture 34 defined by the inner walls 32 of tube member 28 and frictionally retained therein by frictionally engaging the inner walls 32 of the tubular member 28. Each of the burning candles 60*a*, 60*b*, 60*c*, 60*d* and 60*e* may move axially in the directions of the arrows 62 and 64 against the frictional retention thereof. The burning candles are illustrated in FIG. 3.

Figure 3:
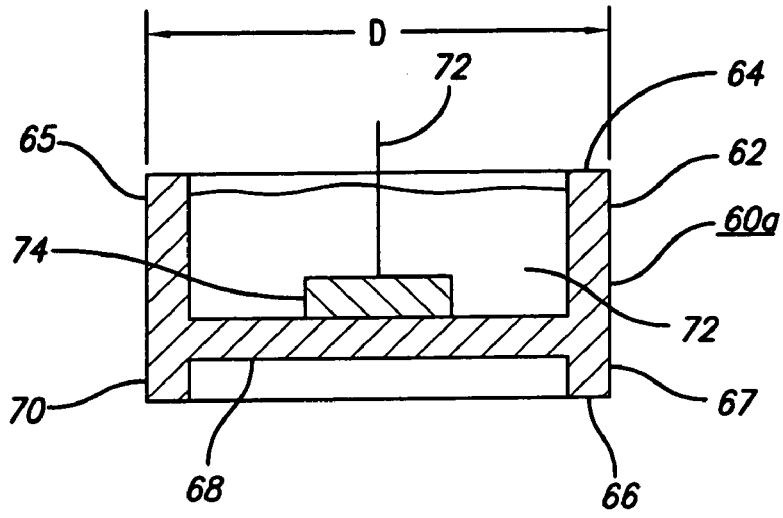
FIG. 3 is a cross sectional view of a mold useful in the practice of the present invention.

As shown on FIG. 3, burning candle 60*a* has a tubular case 62 having a top edge 64 at an upper end 65 and a bottom edge 66 at a bottom end 67 and a base member 68. The tubular case 62 has an outer diameter "D" that is the substantially same as the inner diameter of the tubular member 28 (FIG. 1) and the diameter of the aperture 88 in retainer 80 (FIG. 4, 5). The diameters of these parts is selected to provide the sliding frictional fit of the burning candles 60*a*, 60*b*, 60*c*, 60*d* and 60*e* in the tubular member 28.

The base member 68 is spaced from the bottom edge 66 of the tubular case 62. Such spacing defines a separating ring portion 70. The interior of the tubular case 62 is filled with a burning candle wax 72 having a lower melting point than the main candle body. The burning candle is provided with a wick 72 held in place by a coupling means 74 against the base member 68. For the condition of the plurality of burning candles aligned as shown on FIG. 1, the separating ring 70 of each burning candle ensures that the bottom edge 66 of each burning candle engages the top edge 64 of the immediately adjacent burning candle and the separating ring prevents the base 68 from s engagement with any of the candle wax in the burning candle below. Such separation prevents the heat from the burning candle that is burning, such as burning candle 60*a* from melting the wax of the next burning candle 60*b*.

As shown on FIG. 1, a retainer 80 is provided at the top surface 24 of the main candle body 14. The outer wall 30 of the tubular member 28 engages the retainer 80 as discussed below in connection with FIGS. 4 and 5. The retainer 80 has a flange portion 82 spaced from the upper surface 24 of the main candle body 14 to aid in retention of the retainer 80 in the main candle body 14.

Referring now to FIGS. 4 and 5, there is illustrated the retainer 80 shown in FIG. 1 and a phantom line showing of the tubular member 28 on FIG. 4. As shown on FIGS. 4 and 5, the retainer 80 has a top portion 84 and walls 86 in a shoulder portion 87 defining an aperture 88 through the top portion 84. The diameter "D" of the aperture 88 is the same as the inner diameter defined by the inner walls 32 of tubular member 28. As installed in a main candle body (FIG. 1), the upper surface of top portion 84 of retainer 80 is coplanar with the upper surface 24 of the main candle body 14.

The retainer 80 has an inner downwardly depending tube portion 92 having an outer wall 93 and an inner wall 94 thereof and the inner wall 94 bears against the outer wall 30 of the tubular member 28. There is also provided an outer downwardly depending tube portion 96 connecting the top portion 84 with the flange portion 8. the outer downwardly depending tube portion 96 is spaced radially outwardly from the inner downwardly depending tube portion 92 to define the space 100 therebetween. The burning candles 62*a*–62*e* are retained by the removable frictional fit of the outer wall of the burning candles and the inner wall of the tubular member 28. Additionally, the walls 86 of the retainer 80 have a sliding, removable frictional fit with the outer walls of the top most burning candle 60*a*.

In utilizing the candle arrangement 12 of embodiment 10 as shown on FIG. 1, the plurality of burning candles 60*a*, 60*b*, 60*c*, 60*d* and 60*e* are inserted into the candle receiving aperture 34 defined by the tubular member 28 in either direction indicated by the arrows 62 and 64. When properly aligned, the wick 72 of the upper most burning candle 60*a* is lit and the candle may continue to burn until the wax 72 thereof is consumed. The consumed burning candle 64*a* may be ejected from the candle receiving aperture 34 by pressing upwardly in the direction of the arrow 62 on the lowest burning candle 60*e* until the burning candle 60*b* is properly positioned. A new burning candle may then be placed in the in the space previously occupied by the burning candle 64*e*. Alternatively, the consumed burning candle 60*a* may be pressed downwardly in the direction indicated by the arrow 64 until the burning candle 60*e* is ejected. The burning candle 60*e* may then be placed in the position previously occupied by the burning candle 60*a*. This process replacement be continuously repeated as often as desired since the main candle body 14 is not consumed during the burning of the burning candles and, further, the difference in melting points between the burning candle wax 72 and the main candle body 14 prevents even the melting of the main candle body 14 while the burning candles are consumed. Since it is only the burning candle in the top most position such as the position shown for burning candle 60*a*, the tube 28 and the retainer 80 act as thermal barriers to minimize the heat transfer from the burning candle to the main candle body. In the preferred method of operation, the candle arrangement 10 is utilized with all burning candles in place. that is, when one consumed burning candle is removed a replacement unburned candle is placed in tube 28 so that the tube 28 is always full during the burning of a burn candle.

Figure 2:
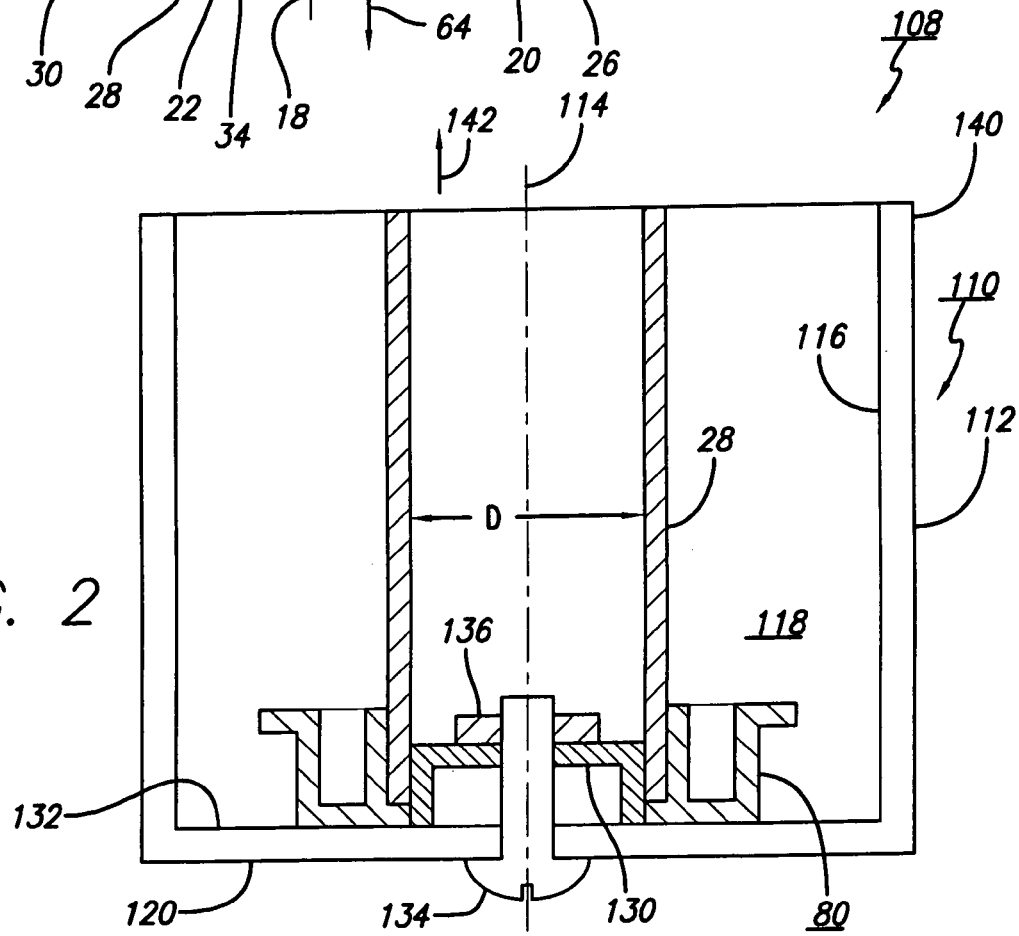
FIG. 2 is a cross sectional view of a burning candle useful in the practice of the present invention.

The main candle body may be fabricated in a molding process with the tubular member 28 and retainer 80 in place. FIG. 2 illustrates one type of mold useful in the production of the main candle body. In this embodiment 108 there is provided a mold 110 comprised of a generally tubular outer case 112. In the embodiment 108 of FIG. 2, the case 112 is made in one piece and is generally circular in cross section about the mold axis 114. The inner wall surface 116 of the case 112 defines a main candle body receiving aperture 118. The mold 110 has a base portion 120 having an inner wall surface 122.

A tube member 28 is positioned in the outer case 112 concentrically with the axis 114 and inserted into a retainer 80. As shown on FIG. 2, the retainer 80 and tubular member 28 are separate members. However, in other preferred embodiments of the present invention, the retainer 80 and tubular member 28 may be unitarily fabricated such as by a molded plastic or by fixedly attaching the retainer to the tubular member.

A plug 130 is positioned on the inside surface 132 of the base portion 120 may be embossed with any desired ornamental configuration to decorate the top surface 24 of the main candle body 14. the plug 130 is retained in place by the screw 134 and nut 136. The plug 130 may have any desired axial length sufficient to hold the tubular member 28 and retainer 80 in place during the molding process. In other preferred embodiments of the present invention, the plug 130 may be a permanent part of the base portion 120 of the mold 110.

The comparatively high melt point wax 115 of the main candle body 14 is poured into the cavity 118 and fills the cavity 118 from the inside surface 132 of the base portion 120 to regions slightly spaced from the remote end 140 of the outer case 112 as indicated by the dotted line 140'. When the wax 115 has hardened there is a normal shrinkage of the wax so that the end surface, 118' of the wax 118 is closer to the base portion 120 of the mold 110. In order to remove the main candle body 14 from the mold 110 the exposed portion 28' of the tube 28 is grasped and by sliding motion in the direction of the arrow 142 is removed from the mold 110. The exposed portion of the tube 20 may then be trimmed to be flush with the 26 as shown in FIG. 1. The burning candles 60*a*, 60*b*, 60*c*, 60*d* and 60*e* may then be installed in the tube 28 as above described.

FIG. 7 illustrates another preferred embodiment of the present invention generally designated 200. The embodiment 200 is generally similar to the embodiment 10 described above in connection with FIG. 1 and comprises a candle arrangement 201. As shown on FIG. 7, there is provided a main candle body 202 similar to the main candle body 14 fabricated from a first relatively high melting point wax 204 similar to the candle wax 115. The retainer 80 is provided in the embodiment 200 and provides the same function as the retainer 80 in the embodiment 10. In the embodiment 200, there is provided a tubular member 206 having inner walls 208 and outer walls 210. The inner walls 208 of the tubular member 206 define a burning candle receiving aperture 211. In the embodiment 200, the tubular member 206 is positioned against the outer wall 93 of retainer 80 thereby leaving an air gap 212 in the aperture 211 between the inner wall 208 of tubular member 206 and the outer walls of the burning candles 60*a*-60*f*. The burning candles 60*a*-60*f* may be similar to burning candles 60*a*-60*e* described above as shown on FIG. 3. The air gap 212 provides an additional thermal insulating function between the burning candle 60*a* and the tubular member 206 and the wax 204. The top most burning candle 60*a* in embodiment 200 has a sliding frictional engagement with the walls 86 of retainer 80 for frictional retention thereof. In the embodiment 200 the plurality of burning candles 60*a*-60*f* may have slight radial movement in the direction of the arrow 214.

A bottom plug 210 comprising a cup-like member is inserted into the bottom portion 206*a* of tubular member 206 for a sliding frictional retention with the inner wall 208 of tubular member 206. The bottom plug 210 also bears against the lower surface 60*f'* of bottom burning candle 60*f* to retain the axial alignment of the burning candles 60*a*–60*f*.

The tubular member 206, as well as the tubular member 28 shown in FIG. 1 may be fabricated from cardboard, plastic, metal, ceramic or any other desired material suitable for the operation of the embodiments of the present invention.

In utilizing the candle arrangement of embodiment 200, after the top most candle 60*a* has burned and consumed all the wax therein, the bottom plug 210 may be removed to allow the bottom burning candle 60*f* to be removed from the burning candle receiving aperture 21. The bottom plug 210 is then reinserted into the burning candle aperture 211 and the burning candle 60*f* is inserted into the burning candle receiving aperture 211 at the position of the topmost burning candle thereby forcing the now burned out candle 60*a* to be in the second position. This process may be repeated until all of the burning candles 60*a*–60*f* have been consumed and then a new stack of unburned burning candles may be loaded into the burning candle receiving aperture 211. Therefore, in embodiment 200, the burning candle receiving aperture 211 is always full with either unburned burning candles or a mixture of one or more burned burning candles and one or more unburned burning candles.

FIG. 8 illustrates another preferred embodiment 220 of a candle arrangement 222 which is generally similar to the embodiments 10 and 200 described above. The candle arrangement 222 has a main candle body 223 which is generally similar to the main candle bodies 14 and 204 described above. The candle arrangement 222 has a retainer 224 generally similar to the retainer 80 described above but does not have the shoulder portion 87 described above. A tubular member 225 is positioned against the inner downwardly depending tube portion 229 and extends to the top surface 222*a* of the main candle body 223. The embodiment 220 may be operated in a manner similar to that described above in connection with FIG. 1.

If desired, a second tubular member 228 shown in dashed lines may be positioned in the retainer 225 in a manner as described above in connection with embodiment 220 the second tubular member 228 has inner walls 231 spaced from the first tubular member 225 to define a first air gap 234 therebetween which can provide additional thermal insulation between a burning candle 60*a* and the main candle body 223.

If desired, a third tubular member 236 shown in dashed lines having inner walls 238 and outer walls 240 may be positioned against an outer downwardly depending tube portion 242 to define a second air gap 244 between the inner wall 238 of second tubular member 236 and outer wall 246 of first tubular member 228 to provide additional thermal insulation.

The first, second and third tubular members may be fabricated from the same material such as the materials described above or may be fabricated from different materials as may be desired for particular applications. Alternatively, the first tubular member may be omitted from embodiment 220 and the plurality of burning candles such as 60*a* and 60*b* shown on FIG. 8 may be positioned as shown in embodiment 200 with the inner wall surface of the inner downwardly depending tube portion 229 providing the frictional sliceable fit to the top most burning candle 60*a*. In this alternative embodiment, only the second tubular member 228 and third tubular member 236 may be utilized as desired for particular applications. In other alternative embodiments of the embodiment 220, the second tubular member 228 may be omitted and just the first tubular member 225 and the third tubular member 236 may be utilized as desired for particular applications.

Although specific embodiments of the present invention have been described above with reference to the various Figures of the drawing, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

What is claimed is:

1. An improved candle arrangement comprising, in combination:

a main candle body comprised of a candle wax having a first melt point, and said main candle body having an outer wall surface having a preselected circumferential geometric configuration, a top surface and a bottom surface; said main candle body having first interior walls defining an aperture extending through said main candle body from said top surface to said bottom surface;

a plurality of burning candles movably insertable for frictional retention and sliding movement in said aperture of said main candle body between regions adjacent said top surface and adjacent said bottom surface, and each of said plurality of burning candles having a generally tubular outer case defining an open topped cavity therein, a base coupled to said outer case and a wick, and a candle wax in said cavity of said tubular case and said candle wax of each of said plurality of burning candles having a second melt point less than said first melt point of said main candle body, whereby, said burning candle at said top surface of said main candle body may be burned until consumed and the consumed burning candle may be removed from said aperture in said main candle body and replaced with a new burning candle.

2. The arrangement defined in claim 1 and further comprising:

a tubular member in said aperture of said main candle body and abutting said interior walls of said main candle body, and said tubular member having a melting point higher than said meting point of said candle wax in said burning candles; and, said outer case of each of said burning candles having outer wall surfaces engaging inner wall surfaces of said tubular member for said frictional retention and sliding movement.

3. The arrangement defined in claim 2 wherein:

said generally tubular outer case of each of said plurality of burning candles has a top edge portion having a top edge surface and a bottom edge portion having a bottom edge surface, and said base of each of said plurality of burning candles coupled to said generally tubular outer case in spaced relationship to said bottom edge portion of said outer case to define a extending ring portion of said outer case.

4. The arrangement defined in claim 3 and further comprising:

a retainer mounted in said main candle body adjacent said top surface thereof and said retainer having a top portion having a top edge surface substantially coplanar with said top surface of said main candle body, ans said retainer engaging said tubular member in regions adjacent said top surface of said main candle body, and said retainer having a higher melting point than said candle wax of said burning candles to provide a thermal barrier to minimize heat transfer from said burning candle to said main candle body.

5. The arrangement defined in claim 4 and wherein:

said retainer has a flange portion extending radially outwardly and said flange portion spaced from said top surface of said main candle body.

6. The arrangement defined in claim 5 wherein:

said top portion of said retainer has walls defining an aperture therethrough.

7. The arrangement defined in claim 6 wherein:

said preselected circumferential configuration of said main candle body is circular and defines a main axis;

said aperture in said main candle body is circular in cross section and is aligned concentrically with said main axis said tubular member is circular in cross section and is aligned concentrically with said main axis;

said aperture in said top portion of said retainer is circular and is aligned concentrically with said main axis.

8. The arrangement defined in claim 7 wherein:

said tubular outer case of said each of said plurality of burning candles is circular and for the condition of each of said burning candles mounted in said tubular member are aligned concentrically with said main axis.

9. The arrangement defined in claim 1 and further comprising:

said main candle body having second interior walls defining a plurality of apertures extending through said main candle body from said top surface to said bottom surface;

a plurality of burning candles movably insertable for frictional retention and sliding movement in each of said plurality of apertures of said main candle body between regions adjacent said top surface and adjacent said bottom surface, and each of said plurality of burning candles having a generally tubular outer case defining an open topped cavity therein, a base coupled to said outer case and a wick, and a candle wax in said cavity of said tubular case and said candle wax of each of said plurality of burning candles having a second melt point less than said first melt point of said main candle body.

10. The arrangement defined in claim 1 and further comprising:

at least one tubular member in said aperture of said main candle body and said at least one tubular member extending from regions adjacent said top surface of said main candle body to regions adjacent said bottom surface of said main candle body; and, said plurality of burning candles in said at least one tubular member.

11. The arrangement defined in claim 9 and further comprising:

at least one tubular member in each of said apertures of said main candle body and said at least one tubular member in each of said apertures of said main candle body extending from regions adjacent said top surface of said main candle body to regions adjacent said bottom surface of said main candle body; and, said plurality of burning candles in each of said at least one tubular member in each of said apertures of said main candle body.

12. An improved candle arrangement comprising, in combination:

a main candle body comprised of a candle wax having a first melt point, and said main candle body having an outer wall surface having a preselected circumferential geometric configuration, a top surface and a bottom surface; said main candle body having first interior walls defining an aperture extending through said main candle body from said top surface to said bottom surface;

a first tubular member in said aperture of said main candle body and having an inner surface and an outer surface, and said first tubular member extending from regions adjacent said bottom surface of said main candle body to regions adjacent said top surface of said main candle body; and said first tubular member having a combustion point higher than said melting point of said candle wax in said burning candles; and, a plurality of burning candles movably insertable in said aperture of said main candle body between regions adjacent said top surface of said main candle body and adjacent said bottom surface of said main candle body, and each of said plurality of burning candles having a generally tubular outer case defining an open topped cavity therein, a base coupled to said outer case and a wick, and a candle wax in said cavity of said tubular case and said candle wax of each of said plurality of burning candles having a second melt point less than said first melt point of said main candle body, and said inner walls of said first tubular member spaced from said tubular outer case of said burning candles to define a first air gap therebetween;

whereby, said burning candle at said top surface of said main candle body may be burned until consumed and the consumed burning candle may be removed from said aperture in said main candle body and replaced with a new burning candle.

13. The arrangement defined in claim 12 and further comprising:

a second tubular member in said aperture of said main candle body and having an inner surface and an outer surface, and said second tubular member extending from regions adjacent said bottom surface of said main candle body to regions adjacent said top surface of said main candle body; and said first tubular member having a combustion point higher than said melting point of said candle wax in said burning candles; and, said inner surface of said second tubular member spaced from said outer surface of said first tubular member to define a second air gap therebetween.

14. The arrangement defined in claim 12 and further comprising:

a retainer mounted in said main candle body adjacent said top surface thereof and said retainer having a top portion having a top edge surface substantially coplanar with said top surface of said main candle body, ans said retainer engaging said first tubular member in regions adjacent said top surface of said main candle body, and said retainer having a higher melting point than said candle wax of said burning candles to provide a thermal barrier to minimize heat transfer from said burning candle to said main candle body.

15. The arrangement defined in claim 13 and further comprising a retainer mounted in said main candle body adjacent said top surface thereof and said retainer having a top portion having a top edge surface substantially coplanar with said top surface of said main candle body, ans said retainer engaging said first tubular member in regions adjacent said top surface of said main candle body, and said retainer having a higher melting point than said candle wax of said burning candles to provide a thermal barrier to minimize heat transfer from said burning candle to said main candle body.

16. The arrangement defined in claim 12 wherein:

said retainer further comprises:

an inner downwardly depending tube portion having an inner wall surface spaced from said tubular outer case of said burning candles and an outer surface; and, said first tubular member having an upper end portion in regions adjacent said top surface of said main candle body and said upper end portion adjacent said outer surface of said inner downwardly depending tube portion.

17. The arrangement defined in claim 13 wherein;

said retainer further comprises:

an inner downwardly depending tube portion having an inner wall surface spaced from said tubular outer case of said burning candles and an outer surface; and, an outer downwardly depending tube portion having an inner wall surface and an outer wall surface, and said inner wall surface of said outer downwardly depending tube portion spaced from said outer wall surface of said inner downwardly depending tube portion;

said first tubular member having an upper end portion in regions adjacent said top surface of said main candle body and said upper end portion adjacent said outer surface of said inner downwardly depending tube portion;

said second tubular member having an upper end portion in regions adjacent said top surface of said main candle body and said upper end portion of said second tubular member adjacent said inner surface of said outer downwardly depending tube portion.

* * * * *